US009624636B2

(12) United States Patent
Andrus et al.

(10) Patent No.: US 9,624,636 B2
(45) Date of Patent: Apr. 18, 2017

(54) MULTI-STAGE SUSPENDED WAVE SCREEN AND COASTAL PROTECTION SYSTEM

(71) Applicant: Integrated Shoreline Solutions, LLC, Lafayette, LA (US)

(72) Inventors: Thomas Mitchell Andrus, Church Point, LA (US); James Paul Quackenbos, Jr., Abbeville, LA (US); Michael Leon Pugh, Jr., New Orleans, LA (US)

(73) Assignee: Integrated Shoreline Solutions, LLC, Lafayette, LA (US)

( * ) Notice: Subject to any disclaimer, the term of this patent is extended or adjusted under 35 U.S.C. 154(b) by 109 days.

(21) Appl. No.: 14/216,410

(22) Filed: Mar. 17, 2014

(65) Prior Publication Data

US 2014/0270962 A1 Sep. 18, 2014

Related U.S. Application Data

(60) Provisional application No. 61/852,215, filed on Mar. 15, 2013.

(51) Int. Cl.
*E02B 3/06* (2006.01)
*E02B 3/04* (2006.01)

(52) U.S. Cl.
CPC ..... *E02B 3/06* (2013.01)

(58) Field of Classification Search
CPC ..... E02B 3/04; E02B 3/06
USPC ..... 405/21, 30, 302.7
See application file for complete search history.

(56) References Cited

U.S. PATENT DOCUMENTS

| | | | | |
|---|---|---|---|---|
| 2,474,786 | A | 6/1949 | Humphrey | |
| 3,011,316 | A * | 12/1961 | Wilson | E02B 3/06 256/12.5 |
| 3,118,282 | A | 1/1964 | Jarlan | |
| 3,878,684 | A | 4/1975 | Lamy | |
| 4,154,548 | A | 5/1979 | Ijima | |
| 5,591,333 | A * | 1/1997 | Hobin | E02B 15/06 210/242.4 |
| 6,558,075 | B2 * | 5/2003 | Benedict | E02B 3/06 256/12.5 |
| 6,722,817 | B2 * | 4/2004 | Benedict | E02B 3/04 405/15 |
| 6,932,539 | B2 * | 8/2005 | Benedict | 405/34 |
| 7,165,912 | B2 | 1/2007 | Herzog | |
| 2002/0076282 | A1 | 6/2002 | Hilliard et al. | |
| 2003/0147696 | A1 * | 8/2003 | Hulsemann | E02B 3/06 405/21 |
| 2005/0271470 | A1 * | 12/2005 | Rytand | E02B 3/06 405/21 |
| 2009/0146123 | A1 * | 6/2009 | Hewitt | E01F 7/02 256/45 |

* cited by examiner

*Primary Examiner* — John Kreck
*Assistant Examiner* — Stacy Warren

(57) ABSTRACT

A shoreline protection system comprising a first barrier assembly, which comprises a first pile extending into a bottom of a body of water, a second pile extending into the bottom of the body of water, wherein the first pile and the second pile are spaced apart and essentially parallel relative to each other, and a first screen having an upper edge, a lower edge, and a plurality of apertures extending therethrough, wherein the first screen extends between the first pile and the second pile, wherein the lower edge of the first screen is spaced from the bottom of the body of water.

17 Claims, 4 Drawing Sheets

MULTI-STAGE SUSPENDED WAVE SCREEN AND COASTAL PROTECTION SYSTEM

CROSS-REFERENCE TO RELATED APPLICATIONS

The present application is a non-provisional application claiming priority to the co-pending U.S. provisional patent application having the Ser. No. 61/852,215, entitled "Multi-Stage Suspended Wave Screen and Coastal protection System," filed on Mar. 15, 2013, the entirety of which is incorporated by reference herein.

SPECIFICATION

FIELD

Embodiments usable within the scope of the present disclosure relate, generally, to systems and methods usable in the protection of shorelines from erosion caused by waves, and more particularly, to a pile-supported perforated multi-stage barrier system suspended above the sea floor, which is designed to attenuate waves while allowing tidal exchange through and beneath the barriers.

BACKGROUND

Shoreline erosion is a serious problem along the shores of large bodies of water due to the wave action typically taking place on large bodies of water. Problems associated with shoreline erosion can be even more serious if recreational, residential, and commercial areas along the shoreline are developed right up to the shoreline. Oftentimes, there are structural improvements present at or near the shoreline, such as private beach homes, hotels, bridges, retaining structures, and the like, wherein shoreline erosion progressively undermines the foundations of these structures, threatening the physical integrity of the structures over time. Furthermore, shoreline regions also depend on beach tourism as their main industry; and thus, beach erosion can cause these regions significant economic harm by removing the main tourist attraction.

Shorelines along bodies of water, such as rivers, large lakes, and oceans, can erode from natural erosive processes that removes material from the shoreline, often referred to as "scour." Scour occurs when moving water suspends sand, sediment, or other seafloor material at one location in the flowing water and then redeposits the material at some other location. Many factors specific to the particular shoreline and water velocities can enhance this erosion phenomenon.

Another significant factor enhancing the erosion process is the velocity of the water passing across the shoreline. In order to initiate scour, the water must move at a velocity greater than a critical "suspension velocity" to suspend the sediment of the shoreline in the moving water. The suspension velocity required to initiate scour is dependent upon many location specific factors, such as the geometric shape of the shoreline, the average velocity of the water, the average direction of flow of the water in relation to the shoreline, the depth of the water, the density of the sediment material to be transported.

There have been many devices and methods of hydraulic and earth engineering employed to preserve shorelines or other areas subject to the erosive influence of moving water. The main existing method of combating erosion is to simply renourish an eroding beach with a fresh supply of dredged sand. However, this existing method has many problems.

The dredged sand often does not match the existing color of sand on the beach and diminishes the aesthetic appearance of the beach. The dredged sand can also contain rocks or other solid objects that can hinder water sports, such as swimming or surfing, and can injure or hurt the bare feet of beachgoers upon walking on a renourished beach.

Other methods of preventing shoreline erosion include installation of structures near the shoreline. One example includes laying down a plurality of block members end-to-end from each other along the shore line and, further, another plurality of block members on top of the original layer of block members to provide a wall over which the wave action can pass. The wall constructed by this plurality of block members requires connecting components, such as locking pins, to secure the plurality of blocks together. However, the construction of the shore erosion control wall is labor intensive and time consuming.

Still other methods of preventing shoreline erosion is to fortify the eroding shoreline with blocks, cement, and the like, to form a prophylactic layer over the region of the shoreline that would otherwise be subject to the erosive effects of waves. However, due to the weight and bulk of the fortifying materials, such "armoring" techniques are often difficult to install on the shoreline and problematic to adequately anchor the armor to the underlying shoreline, whether beach, bank, or both. The armored structures often result in permanent structures that are not easily removed from the shoreline and prevent full enjoyment of the region of the shoreline that they overlay.

These structures are typically constructed in shallower waters, for example in depths lying under eighty feet, and simply comprise piled masses of stone or rubble laid on the sea floor to dissipate or attenuate wave energy. In order to attenuate a sufficient amount of wave energy, the structure may be required to be built twenty to thirty feet higher than mean sea level with a base often spanning two hundred feet or more. In many harbor locations, the great mass and size of stone suitable for construction of either vertical wall breakwaters or of capped rubble mounds is not available locally. The wave resisting upper layers of rubble mounds are required to be made of boulders, each weighing many tons, so that the construction of these massive piles of rock involves heavy capital expenditure where the stone must be hauled from remote quarries.

Furthermore, in marsh settings, where weak organic soil is present, the seabed may not adequately support structures that are positioned thereon, such as rocks or blocks. Therefore, unless a shoreline protection system is supported by bases, piles, or a foundation that is deeply imbedded beneath the surface of the seabed, the structure will progressively sink.

Other shore and bank protection techniques and devices known in the art attempt to control erosion by attenuating the energy, velocity, and/or direction of potentially erosive waves and subsurface water currents with the use of certain temporary structures placed on the shoreline. Some of these devices are porous groin structures, which use either flexible or rigid nets, screens, or filters placed in close proximity to the shoreline, substantially perpendicularly to the shoreline, and extending into the surf. The porous groins are placed in the tidal and longshore currents and function much in the same way as a jetty, causing sand to accrete around the porous groin. The porous groin must be constantly moved or removed from the accreting sand or else it becomes stuck in the sediment, requiring extreme forces to be used to dislodge the porous groin from the accreted sediment.

Accordingly, a need exists for a device and method of shoreline protection and/or restoration having a simple construction and disassembly, and whose mass is relatively small in comparison with conventional sea walls or rubble mounds.

Furthermore, a need exists for a device and method for shoreline protection and/or restoration that uses temporary structures to protect and repair the beach by effectively attenuating water wave energy.

A need exists for a shoreline protection system that will not sink when used in marsh settings where loose soil or weak organic soils are present.

Lastly, a need exists for a shoreline protection system that reduces, eliminates, or reverses shoreline erosion while minimizing adverse environmental impacts to the surrounding marsh, with minimal disruption of tidal circulation, fish and marine organism passage, and sediment transport. Such systems and methods should allow the shoreline to undergo natural accretion of sand and sediment while reclaiming the beach without adversely altering the surrounding shoreline.

Embodiments usable within the scope of the present disclosure meet these needs.

SUMMARY

The present disclosure is directed to a shoreline protection system comprising one or more barrier assemblies. The first barrier assembly comprises a first pile extending into a bottom of a body of water and a second pile extending into the bottom of the body of water. The first pile and the second pile can be spaced apart and essentially parallel relative to each other. The barrier assembly can further comprise a first screen having an upper edge, a lower edge, and a plurality of apertures extending therethrough, wherein the first screen can extend between the first pile and the second pile. In an embodiment the lower edge of the first screen can be spaced from the bottom of the body of water. In an embodiment, the shoreline protection system can comprise a second barrier assembly. The second barrier assembly can comprise a third pile extending into the bottom of the body of water, a fourth pile extending into the bottom of the body of water, wherein the third pile and the fourth pile can be spaced apart and essentially parallel relative to each other. The second barrier assembly can further comprise a second screen having an upper edge, a lower edge, and a plurality of apertures extending therethrough, wherein the second screen can extend between the third pile and the fourth pile. The lower edge of the second screen can be spaced from the bottom of the body of water, and the second screen can be essentially parallel relative to the first screen.

The present disclosure is further directed to a barrier for protecting waterfront area from erosion due to waves. An embodiment of the barrier comprises a first pile comprising an upper end and a lower end, wherein the lower end of the first pile can be insertable into a bottom of a body of water, a second pile comprising an upper end and a lower end, wherein the lower end of the second pile can be insertable into the bottom of the body of water, and a first screen having an upper edge, a lower edge, and a plurality of apertures extending therethrough, wherein the first screen can be connectable to the first pile and the second pile at a distance from the bottom of the body of water. In another embodiment of the barrier, the upper end of the first pile can extend above a surface of the body of water, wherein the upper end of the second pile can extend above a surface of the body of water. In yet another embodiment of the barrier, the first screen is movable along the first pile and the second pile.

The present disclosure is further directed to a method of protecting a shoreline against the erosion effects of waves with a barrier assembly. An embodiment of the method comprises the steps of inserting a first pile into a bottom of a body of water, inserting a second pile into the bottom of the body of water, providing a first screen having an upper edge, a lower edge, and a plurality of apertures, and positioning the first screen between the first pile and the second pile. The steps of the method can further include moving the first screen vertically to position the lower edge of the first screen at a distance from the bottom of the body of water, and locking the first screen in position along the first and second piles.

The foregoing is intended to give a general idea of the invention, and is not intended to fully define nor limit the invention. The invention will be more fully understood and better appreciated by reference to the following description and drawings.

BRIEF DESCRIPTION OF THE DRAWINGS

In the detailed description of various embodiments usable within the scope of the present disclosure, presented below, reference is made to the accompanying drawings, in which.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products, and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "lower," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Figure 1:
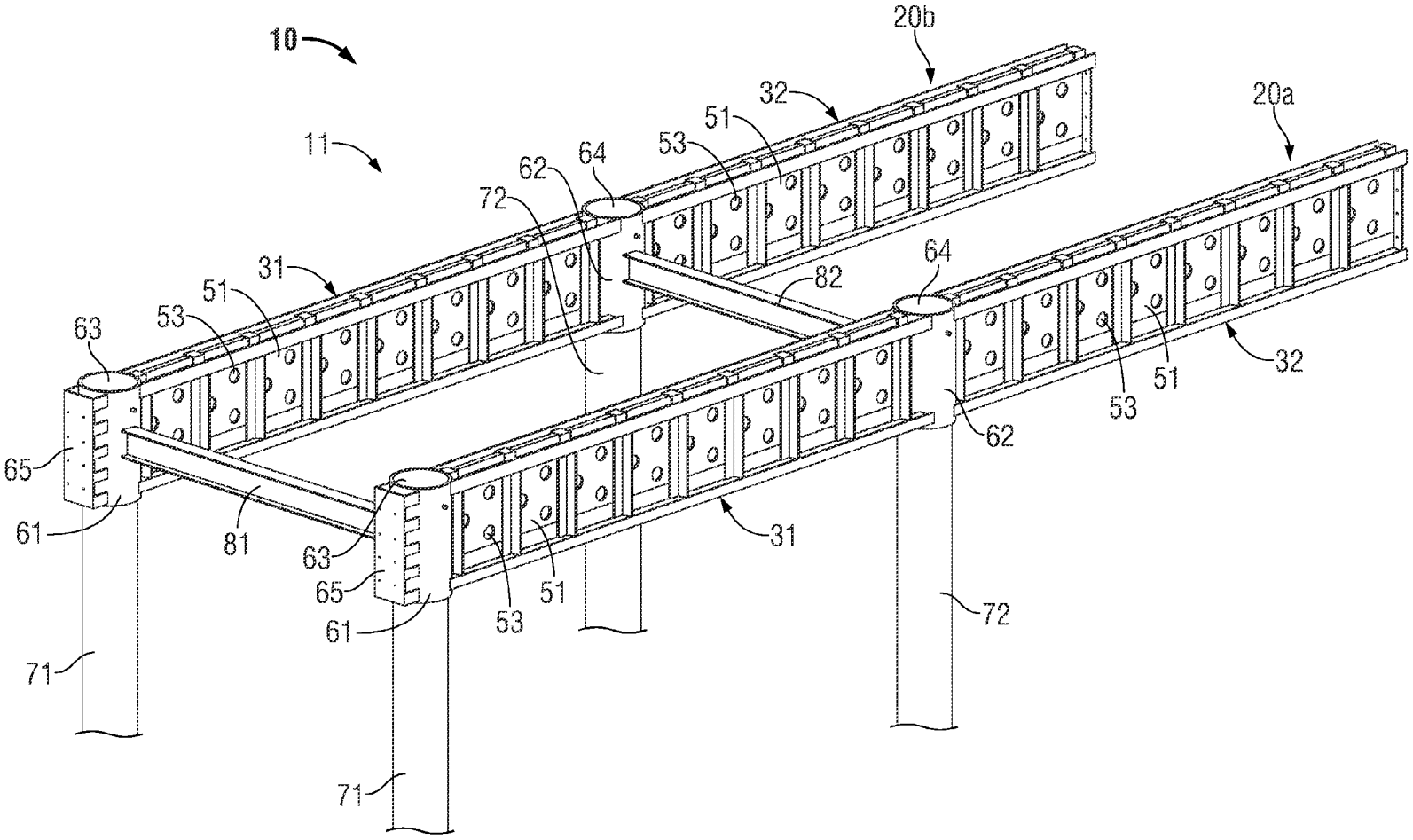
FIG. 1 is a perspective view of an embodiment of a shoreline protection system usable within the scope of the present disclosure.

In describing the shoreline protection system of the present disclosure depicted in FIG. 1, a perspective view of a portion of an embodiment of the shoreline protection system (10) is shown. Specifically, FIG. 1, shows a portion or a segment (11) of the shoreline protection system (10) comprising two wave barriers (20*a*, 20*b*) constructed in a substantially parallel arrangement relative to each other. The shoreline protection system (10) can be installed near a coastline, shoreline, waterfront, or edge of a body of water (not shown). Each barrier (20*a*, 20*b*) is shown comprising two perforated screens (51), wherein each screen (51) is held in place and structurally supported by framing systems (31, 32) extending above, below, and on the sides of each screen (51). The screens (51) can comprise a plurality of openings (53) extending therethrough. FIG. 1 further depicts pile jackets (61, 62) in connection with each framing (31, 32). Each pile jacket (61, 62) is shown positioned over an upper end of a post or a pile (71, 72) to retain each barrier (20*a*, 20*b*) suspended adjacent to top portion of each pile (71, 72). Lastly, the shoreline protection system (10) is shown comprising two lateral support beams (81, 82) extending between a corresponding first pair of pile jackets (61) and the second pair of pile jackets (62).

The segment (11) of the shoreline protection system (10), depicted in FIG. 1, comprises first and second barriers (20*a*, 20*b*), wherein each barrier (20*a*, 20*b*) can comprise two pile jackets (61, 62), the framing (31, 32), and two screens (51). For clarity, the present description uses a single identifying numeral when describing parts and/or elements, which comprise the same or substantially similar structure and/or function. For example, FIG. 1 depicts a segment (11) of the shoreline protection system (10) comprising four screens (51), however, because in the depicted embodiment, the screens (51) comprise the same and/or similar structure and/or function, each screen (51) will be identified by the same numeral for clarity. Furthermore, although subsequent paragraphs comprise a detailed description of an embodiment of a segment (11) of the shoreline protection system (10), it should be understood that each segment can comprise a single barrier (20*a*) and/or a single screen (51) extending between the first and second piles (71, 72).

Referring again to FIG. 1, the depicted segment (11) of the shoreline protection system (10) is based on principals intended to maximize wave energy dissipation while minimizing the overall size of the structure and the negative impact on the environment by allowing flow beneath and through each barrier (20*a*, 20*b*). Irrespective of whether the waves strike the barriers (20*a*, 20*b*) from a direction perpendicular to the shore line or from a direction at an angle thereto, the momentum and action of the moving water can be decelerated by the barriers (20*a*, 20*b*).

Figure 2:
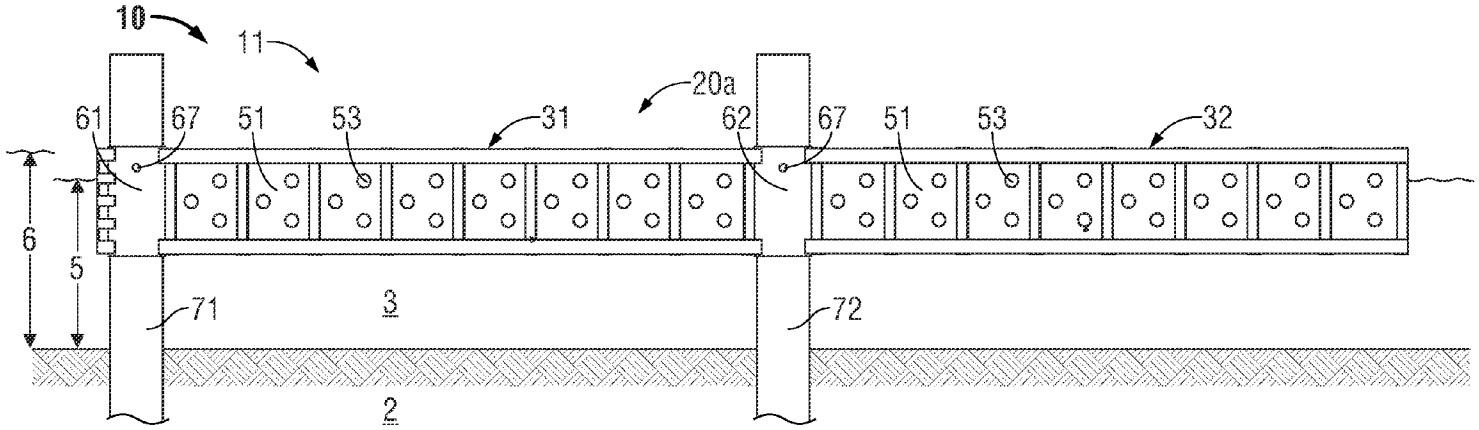
FIG. 2 is a front view of an embodiment of the shoreline protection system usable within the scope of the present disclosure.

Because the majority of energy is contained in the upper portion of the water column of a propagating wave, the wave barriers (20*a*, 20*b*) do not need to extend to the sea floor (not shown), but only extend partially from the water surface to the water bottom. Specifically, the relative depth of submergence (i.e. depth of screen below the still water level divided by the total water depth at the screen location) is optimum at about 67%. Referring now to FIG. 2, showing a side view of the segment (11) of the shoreline protection system (10) in accordance with the present disclosure. Specifically, FIG. 2 depicts the first barrier (20*a*) positioned in a body of water (3), wherein the top of the barrier (20*a*) is above the mean water height (5) and at about the same level as the wave crest height (6). In the depicted embodiment, the barrier (20*a*) is shown extending approximately half way from the water surface to the seabed (2) (e.g., bottom of the body of water), wherein the water surface can be defined at the mean water height (5), wave crest height (6), or combinations thereof. The mean water height (5) can be defined as the distance between the average still water level and the seabed (2), while wave crest height can be defined as the distance between the average wave crest and the seabed (2).

However, when installing the shoreline protection system (10) along deep shorelines or shorelines having drastically changing depths, it may be impossible or impractical to construct a shoreline protection system (10) comprising barriers (20*a*, 20*b*) extending about half-way or 67% below the mean height of the water, towards the seabed (2). Therefore, in other embodiments (not shown) of the shoreline protection system (10), the barriers may extend less or more than half-way or 67% of the distance from the water surface to the seabed (2). However, because the majority of wave energy is contained in the upper portion of the wave, the majority, or at least a significant portion, of the wave energy can still be attenuated by the barrier (20*a*) extending a minor portion of the distance from the water surface to the seabed (2). Although submergence level of about 67% can be optimum, other submergence ratios are also effective. Specifically, it has been found that submergence levels ranging between 34% and 89% effectively attenuated wave energy.

The magnitude of wave attenuation was also found to be dependent on barrier (20*a*) elevation with respect to the mean water height (5) and wave crest height (6), independently of the other parameters. That is, wave attenuation is dependent on the vertical position of the barrier (20*a*), with wave attenuation increasing when the top edge (e.g., end) of the barrier (20*a*) is positioned at about wave crest height (6). Specifically, the closer the barrier (20*a*) is positioned to the crest of the wave, the more drag is exerted on a passing wave, resulting in higher net wave attenuation. As depicted in the embodiment of FIG. 2, the top of the barrier (20*a*) is approximately at the same level as the wave crest height (6) and above the mean water height (5). During operation of the shoreline protection system (10), as the wave collides with the barrier (20*a*), forward water momentum can be decreased by the impact with the screen (51) and turbulent eddy currents can be created as flow accelerates both through the screen openings (53) and beneath the barrier (20*a*). When the eddy currents collide on the shoreline-side of the barrier (20*a*), they can contribute to greater energy dissipation and destructive interference of the wave as it travels past the barrier (20*a*). Additionally, as the waves impact the barrier (20*a*), some of the wave can spill over the top of the barrier (20*a*) to create downward water momentum, which collides with the lateral water flow transmitted through the openings (53) of the barrier (20*a*). These colliding streamlines of water contribute to further dissipation of the wave energy.

To achieve optimum wave dissipation, as described above, the dimensions of each barrier (20*a*, 20*b*), especially the screen (51) portion of the barriers (20*a*, 20*b*), can be designed based on the depth and other water conditions at the location chosen for installation. However, when working with screens having a fixed height along shallow shorelines or shorelines having drastically changing depths, selecting screen height and/or elevation within the body of water is a balance between two conflicting considerations. While lower screen elevation can maximize wave attenuation, a higher screen elevation can allow for more flow beneath the screen, resulting in lower water flow velocities and, therefore, less potential scour. Due to drastic variations in the depth and the topography of the seabed (2), optimal screen (51) height and elevation may not be possible at certain sites. Therefore, the barriers (20*a*, 20*b*) can be installed outside of the optimal positioning, yet still cause a desired level of wave attenuation. Since the seabed (2) elevation often varies along the installation site, the relative submergence depth of each barrier (20*a*, 20*b*) can also vary, resulting in segments (11) of the shoreline protection system (10), wherein the barrier (20*a*) and, therefore, the screens (51) can extend above the wave crest height (6) and/or extend more than half-way toward the seabed (2), while still causing significant wave attenuation. Therefore, areas of different relative barrier (20*a*) submergence (not shown) may exist, where both wave attenuation and scour beneath the barrier (20*a*) will be less, as compared to the areas of greater relative submergence, where both wave attenuation and scour, beneath the screens, will be larger. The peak scour location is expected immediately downstream (i.e., in direction opposite the shoreline) of the first barrier (20*a*), with a possible area of deposition occurring just further downstream. Scour is also expected just behind the second barrier (20*b*), but of lesser magnitude. However, the scour beneath the barriers (20*a*, 20*b*) is expected to be a local occurrence that will not affect shoreline stability or increase shoreline erosion.

As depicted in FIGS. 1 and 2, and as stated above, each of the barriers (20*a*, 20*b*) do not present a solid obstruction in the path of the waves, as the screens (51) comprise a plurality of round openings (53) extending laterally therethrough, wherein moving water, in the form of waves, can pass through the openings (53). As the energy (e.g., water velocity) of a moving wave is substantially reduced in passing through the openings (53), particles of sand and/or other sediments, which are suspended in the water, can be caused to drop and can be deposited on the seafloor (2), which prevents or reduces the scour effect of moving water. A decrease in screen (51) porosity makes each barrier (20*a*, 20*b*) less permeable, which results in less wave transmission. Wave transmission through each barrier (20*a*, 20*b*) can be calculated by comparing wave heights with and without the screens (51).

In the embodiment of the segment (11) of the shoreline protection system (10) depicted in FIGS. 1 and 2, the openings (53) of each screen (51) comprise porosity (i.e. the ratio of area of the openings to the total area of the screen) of 4.3%, resulting in wave attenuation in the order of 50% to 80%, depending on water conditions at the installation site. Although the desired level of wave attenuation of the embodiment of the shoreline protection system (10) of FIGS. 1 and 2 was chosen to be 50% to 80%, other embodiments (not shown) of the shoreline protection system (10) may comprise screens having a higher or lower screen porosity, as required by the water conditions at different locations, which may require more or less wave attenuation. Typically, a screen porosity of 2% to 10% will adequately attenuate wave energy at most shoreline locations.

Furthermore, net wave attenuation of the shoreline protection system (10) within the scope of the present disclosure, further depends upon the distance between the screens (51) of the first and second barriers (20*a*, 20*b*). Specifically, the wave attenuation efficiency of the second barrier (20*b*) can be maximized when placed closer to the first barrier (20*a*), as tighter spacing contributes to higher destructive interference of waves as the waves propagate between the screens (51) of the barriers (20*a*, 20*b*). However, increasing distance between each barrier (20*a*, 20*b*), results in an increased system leverage, rigidity, and structural stability. The embodiment of the shoreline protection system depicted in FIG. 1, comprises a distance of about 10 feet between the screens (51) of the barriers (20*a*, 20*b*), wherein the 10 foot distance sufficiently attenuates waves and provides a sufficient amount of stability to the shoreline protection system (10).

Because several factors control the design of each segment (11) of the shoreline protection system (10), other embodiments of the system can comprise elements having dimensions and structural relationships that are different than those described above and depicted in the embodiments of FIGS. 1 and 2.

As described above, the segment (11) of the shoreline protection system (10) depicted in FIG. 1, comprises two barriers (20*a*, 20*b*) constructed in a generally parallel configuration, wherein each barrier (20*a*, 20*b*) comprises two screens (51) that are connected in line (e.g., in series) by frame assemblies (31, 32) designed to maintain and support each screen (51) in position within a body of water. The frame assemblies (31, 32) can be connected to pile jackets (61, 62) and positioned atop support piles (71, 72) to retain the barriers (20*a*, 20*b*) thereon. Lastly, each support pile can be imbedded in the seafloor (2) to support the weight of the barriers (20*a*, 20*b*) and to withstand the lateral forces exerted upon each barrier (20*a*, 20*b*) by moving water (e.g., waves, tides, etc). Each segment (11) of the shoreline protection system (10), depicted in FIG. 1, can be assembled with a successive segment (not shown) that is the same or similar to the segment (11) described herein, to form a shoreline protection system (10), which can extend along lengthy portions of the shoreline. Subsequent paragraphs comprise a detailed description of specific elements of the shoreline protection system (10). It should be understood that the shoreline protection system (10) can include a plurality of the same or substantially similar segments (11), wherein each segment can comprise the same or substantially similar elements, having the same or substantially the same function, as described herein. It should also be understood that the shoreline protection system (10) can include only a single segment (11), or a portion of each segment (11), if a shorter shoreline protection system (10) is desired.

Referring again to FIG. 2, the figure depicts an embodiment of the shoreline protection system (10) within the scope of the present disclosure. The depicted screens (51) can be constructed from any polymer, composite material, a steel alloy, or any other material having adequate strength to withstand wave loads and having resistance to harsh environmental conditions, such as corrosion, UV rays, etc. In the depicted embodiment, the screen is constructed from ultra-high molecular weight polyethylene (UHMW-PE) marine plastic. UHMW-PE is a UV-stabilized polymer material with excellent resistance to sun and saltwater. Due to the physical and chemical properties of this material, UHMW-PE can be used in harsh environmental conditions without the need for protective coatings or paint. To provide a sufficient level of strength and flexibility, a UHMW-PE screen, having a 0.75 inch thickness, can be used. The UHMW-PE material is significantly lighter than steel, thereby reducing the overall weigh of the segment (11), which improves the ease of transportation and installation, and lessens the chances that the shoreline protection system (10) will sink after installation. Specifically, in another embodiment (not shown) of the shoreline protection system (10), the screens (51) can be fabricated using a range of other materials including various grades of steel, polyethylene, vinyl and fiber glass resin composites, wood and a variety of other materials that can be produced in sheets, having sufficient strength to withstand wave loads, and are rated for extreme marine conditions, such as corrosion, UV rays, etc. If alternate materials are used, for example steel, the framing system, or portions thereof, as described below, may not be necessary, as the screen would not require additional structural support extending between the piles and/or pile jackets, and could also be connected or welded directly to the piles and/or pile jackets.

Furthermore, the screens (51) can be constructed in segments having desired length and height. For example, each screen (51) segment depicted in FIG. 2 has a length of about 23 feet and a height of 4 feet. Furthermore, each screen (51) is shown containing a plurality of perforations or openings (53) formed therein in an alternating manner and generally equally spaced from one another. As described above, the configuration of the openings (53) can be selected based on a desired performance, wherein the number of openings (53) on each screen (51) and opening size can be selected based on the desired level of wave attenuation. FIG. 2 depicts screens (51) comprising 24 openings (53) with each opening having a 6 inch diameter.

Figure 4A:
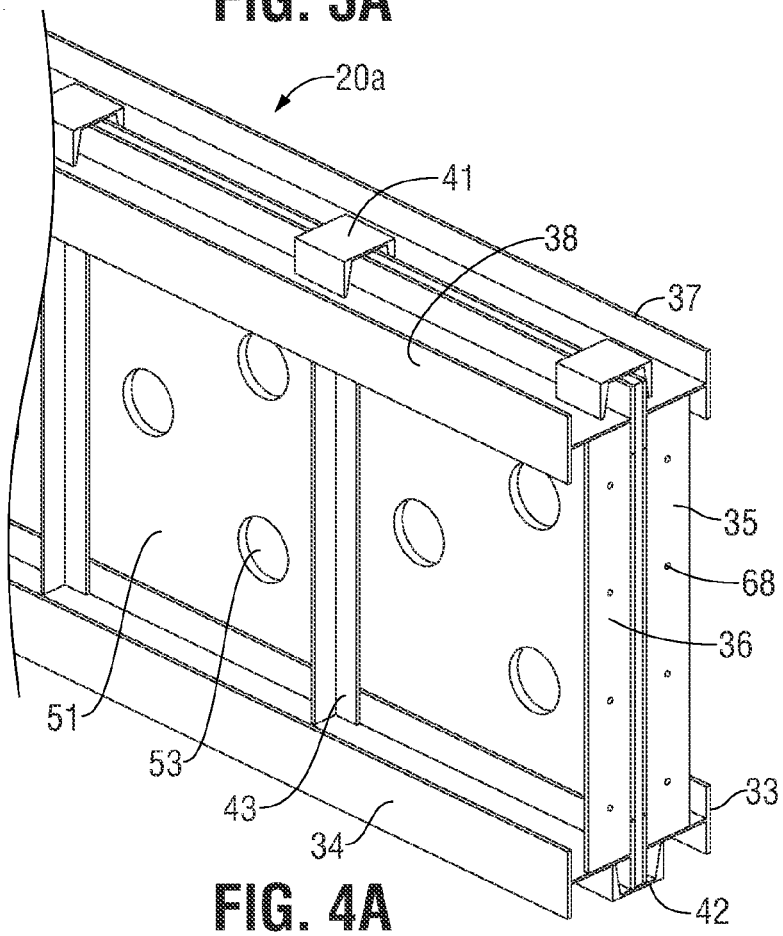
FIG. 4A is a perspective view of a portion of an embodiment of the shoreline protection system usable within the scope of the present disclosure.
Figure 4B:
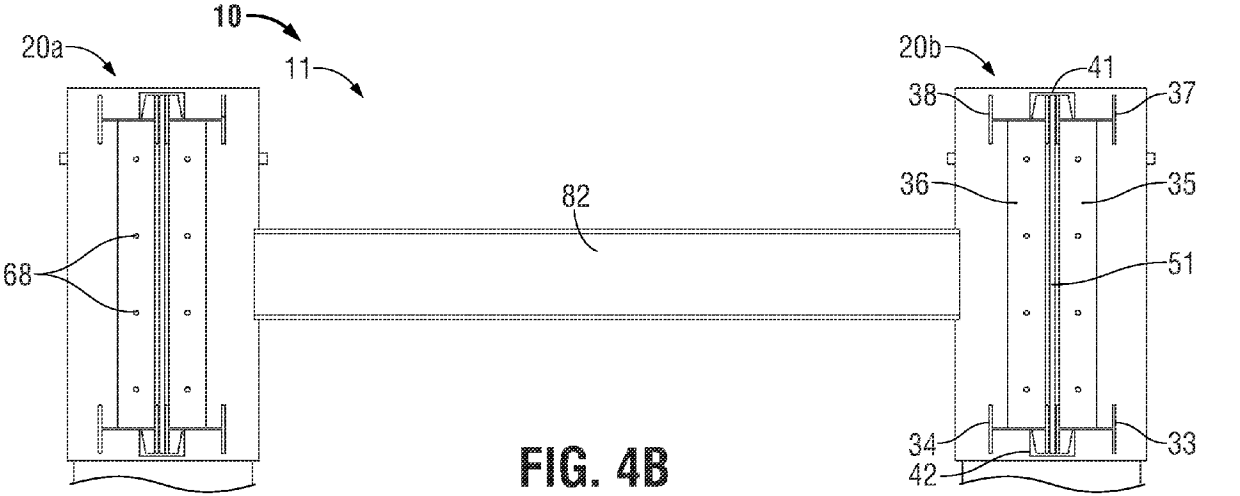
FIG. 4B is a second side view of an embodiment of the shoreline protection system usable within the scope of the present disclosure.

Referring now to FIGS. 4A and 4B, the Figures show a perspective view and a side view of the free end (e.g., not supported by a piles (71, 72)) of an embodiment of a segment (11) of a shoreline protection system (10). The depicted screen framing (32) comprises a plurality of beams positioned around the screen (51), providing the screen (51) with the necessary structural integrity to withstand forces generated by waves and to maintain the screen (51) in the desired position within a body of water (not shown). FIG. 4A depicts the screen (51) supported along the edges and along the interior surface between the edges by a plurality of vertical beams (43), positioned against both faces (e.g., surfaces) of the screen (51), and by a plurality of horizontal beams (37, 38, 33, 34), which are also positioned against both faces of the screen (51) adjacent to upper and lower edges of the screen (51).

As shown in FIGS. 4A and 4B, the framing (32) can comprise two pairs of horizontal support beams (37, 38, 33, 34), depicted as wide-flange (e.g., W, H, or I type) beams, which are oriented flange to flange with sufficient space therebetween to allow a screen (51) to be inserted or slipped into the space. The two pairs of horizontal support beams (37, 38, 33, 34) are positioned at different heights, wherein the upper pair (37, 38) is depicted directly over the lower pair (33, 34). Furthermore, the upper pair of horizontal support beams (37, 38) is positioned about the upper portion of the screen (51) while the lower pair of horizontal support beams (33, 34) is positioned about the lower portion of the screen (51). In an embodiment of the segment (11) of the shoreline protection system (10), depicted in FIGS. 4A and 4B, the horizontal support beams (37, 38, 33, 34) can be wide flange W8×24 beams, because of their high section modulus and a low weight; however, in other embodiments of shoreline protection system (10), different beam shapes may be used.

Referring again to FIG. 4A, the screen framing (32) can also include a plurality of additional vertical beams or vertical struts (43), depicted as a plurality of L shape angle beams and arranged vertically along the face of the screen (51). The vertical struts (43) can be positioned vertically on both sides of the screen (51) between the upper (37, 38) and lower (33, 34) horizontal beams against the face of the screen (51). The vertical struts (43) can allow the screen (51) to flex laterally, but at the same time, provide the screen (51) sufficient reinforcement to prevent wave forces from fracturing the screen (51). The amount of force applied to each vertical strut (43) depends on the spacing between each vertical strut (43), as the force of a wave is generally uniformly distributed in kips (i.e. kilopounds force) per foot. In the embodiment of the shoreline protection system (10) shown in FIGS. 2 and 4A, the vertical struts (43) are depicted as L5×5×5/16 angle beams, which are sized to provide sufficient bearing surface for contact with the screen (51) panel. The Figures also depict a vertical strut (43) separation of 2 feet and 9 inches. The configuration of the vertical struts (43) provide the screen (51) with the necessary support to withstand significant wave forces without adding significant weight to the barrier (20*a*). It should be understood that FIGS. 2 and 4A depict a single embodiment of the shoreline protection system (10), and other shaped beams, including rectangular bars or sheets, having different spacing therebetween, can be used within the scope of the present disclosure.

Figure 5:
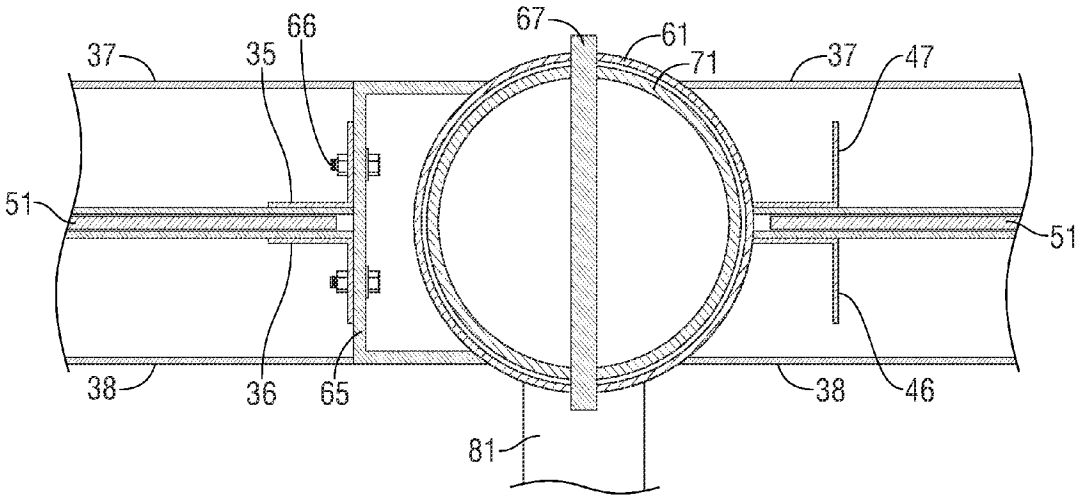
FIG. 5 is a top cross-sectional view of a portion of an embodiment of the shoreline protection system usable within the scope of the present disclosure.

As shown in FIGS. 1 and 2, one end of the horizontal support beams (38, 34) of the second framing (32) is connected to the second pile jacket (62), while the other end of the horizontal support beams (38, 34) are free and adapted for connection to another pile jacket (not shown), as shown in FIG. 4A and described below. Specifically, the screen framing (32) can also include a pair of vertical support beams (35, 36), depicted in FIGS. 4A and 4B as an L shape angle beam. Each vertical support beam (35, 36) is oriented surface-to-surface, with sufficient space therebetween to allow the screen (51) to be inserted. The vertical support beams (35, 36), shown in FIG. 4A, are shown positioned at the free end of the segment (11) for mating with the pile jacket flange (65) depicted in FIGS. 3A and 3B. A connection between vertical support beams (35, 36) and the pile jacket flange (65) is depicted in FIG. 5, which shows a top view of an embodiment of the pile jacket (61). FIG. 5 also depicts another pair of vertical support beams (46, 47), usable to hold the side edges of the screen (51) between the first pile jacket (61) and the second jacket (62, not shown). The vertical support screens (46, 47) can be permanently connected to the first pile jacket (61) or the second pile jacket (62, not shown) to support the side of the screen (51).

Once the screens (51) are inserted into the framing (31, 32), the screens (51) can be retained therein by any means known in the industry, including friction (i.e. interference fit) between the screen (51) and the framing (31, 32), by a plurality of bolts (not shown) strategically placed through the screen (51) and framing (31, 32) elements, or by a plurality of brackets (not shown) fixed to the framing (31, 32). In order to prevent the screen (51) from sliding out of the top or lower of the framing (31, 32), a plurality of channel U shaped beam segments (41, 42) can be positioned against the top and lower edges of the screen (51), as depicted in FIGS. 4A and 4B. The Figures further show the segments welded to the horizontal support beams (37, 38, 33, 34) with the web (e.g., concave) portion of each segment (41, 42) abutting the upper and lower edges of the screen (51) to retain the screen (51) in place within the framing (32). The beams segments (41, 42) are depicted in FIGS. 4A and 4B as MC 6×15.3 channel beam segments.

Figure 3A:
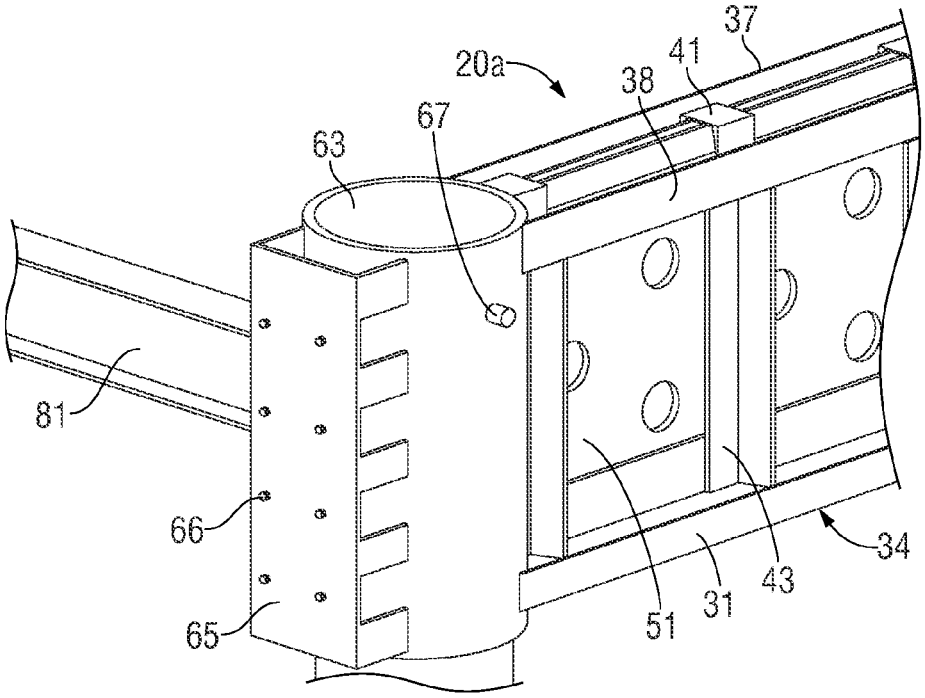
FIG. 3A is a perspective view of a portion of an embodiment of the shoreline protection system usable within the scope of the present disclosure.

The framing (31, 32) can be assembled and positioned in the configuration, described above, by any means known in the art. In the embodiment of the shoreline protection system (10), depicted in FIGS. 4A and 4B, the vertical support beams (35, 36) and the vertical struts (43) are shown welded to the horizontal beams (37, 38, 33, 34). In order to connect the framing (31, 32) to the vertical piles (71, 72), pile jackets (61, 62) can be used. Referring also to FIGS. 3A and 5, the Figures show a perspective view and a top view of the supported end (e.g., supported by the pile (71*a*)) of an embodiment of the segment (11) of the shoreline protection system (10). The Figures depict the horizontal beams (37, 38, 34) in connection with a pile jacket (61) by welding means. In another embodiment (not shown) of the shoreline protection system (10), the pile jacket (61) and the horizontal beams (37, 38, 33, 34) can be held together by the use of strategically located rivets or bolts.

Figure 3B:
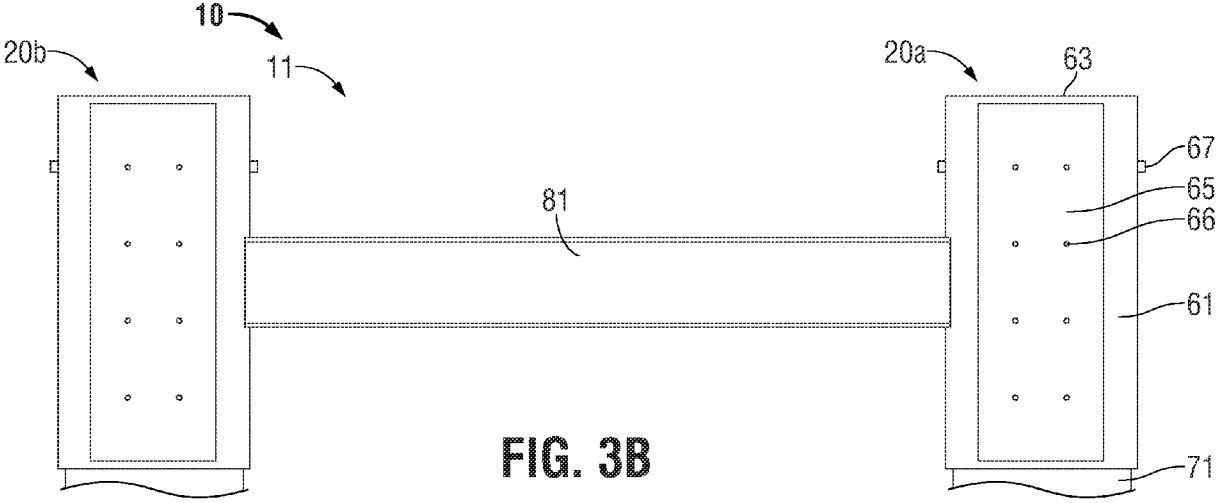
FIG. 3B is a first side view of an embodiment of the shoreline protection system usable within the scope of the present disclosure.

As depicted in FIGS. 3A, 3B, and 5 the pile jacket (61) comprises a tubular member, such as a pipe section, positioned about the pile (71). It should be understood that the pile jacket (61) can be configured as a sleeve member, which can be positioned about the pile (71). During installation of the shoreline protection system (10), a circular plate (63), can be attached over the upper opening of the tubular body of the jacket (61) to close or seal off the upper opening. The inside diameter of the jacket (61) should be sufficiently larger than the outside diameter of the pile (71), allowing the pile jacket (61) to receive the pile (71) as the pile jacket (61) is positioned about the top of the pile (71) during installation of the shoreline protection system (10). However, the fit between the jacket (61) and the pile (71) should be sufficiently close in order to prevent excessive movement of the jacket (61) during operation due to forces created by waves and other water movement. The pile jacket (61) may be maintained connected to the top of the pile (71) by any means known in the art, including the means described above, such as welding or by use of plurality of strategically placed bolts extending therebetween. The jacket (61) can also be maintained in position about the pile by the use of one or more retaining pin type connections. As depicted in FIGS. 3A and 5, the jacket (61) can be retained atop the pile (71) by a retaining pin (67), such as a round bar stock, which penetrates the jacket (61) and the pile (71) laterally through openings formed therein. As the jacket (61) is placed atop the pile (71), the openings in the pile and the jacket align, allowing the retaining pin (67) to be inserted therethrough, maintaining the connection between the two components. In the embodiment depicted in FIGS. 3A and 5, the pile jacket (61) can comprise a wall thickness of 0.50 inches with an outside diameter of 26 inches, which is two inches larger than the outer diameter of the pile (71). The retaining pin (67) can be formed from a 28 inch long, 1.50 inch diameter round bar stock, which can be retain in position by interference fit, by a cotter pin (not shown), or by other means known in the art.

In another embodiment of the shoreline protection system (10), depicted in FIG. 2, the circular plates (63, see FIG. 1) can be omitted and the piles (71, 72) can extend through and above the pile jackets (61, 62) a predetermined distance. The upper ends of the piles (71, 72) can be covered by circular plates (not shown) in a similar fashion as described above. The additional pile length allows the shoreline protection system (10) to be adaptable to changing environmental conditions. Specifically, the additional pile length extending above the pile jackets (61, 62) allows each barrier (20*a*, 20*b*) to be raised to accommodate for water level rise, change in wave height, siltation, change in seafloor level or conditions, and other changes. The additional pile length also makes the shoreline protection system more visible to mariners. To adjust the height, the pins (67) can be extracted and reinserted through the pile jackets (61, 62) and the piles (71, 72) after the barriers (20*a*, 20*b*) are raised.

The free end of the segment (11), depicted in FIG. 4A, can be connected to the supported end of the segment (11), depicted in FIG. 3A, by use of a pile jacket flange (65), as depicted in FIGS. 1 and 5. The pile jacket flange (65) is depicted in FIGS. 3A, 3*b*, and 5 as a rectangular plate oriented vertically and facing the pile jacket (61). The flange (65) is further depicted connected to the pile jacket (61) by a plurality of smaller plates, which are shown extending between the flange (65) and the pile jacket (61). The flange (65) is further depicted comprising a plurality of threaded bolts (66) extending through or from the face of the flange (65). The bolt pattern can be adapted to match the hole (68) pattern in the vertical support beams (35, 36), allowing the bolts (66) to be inserted into the holes (68) to form a connection between the pile flange (65) and the vertical support beams (35, 36), thereby forming a connection between the free end of the segment (11) with the supported end of an adjacent segment (11). Although FIGS. 3A and 5 depict the jacket flange (65) being welded to the pile jacket (61), other known means for forming a connection can be used.

As described above and shown in FIGS. 1 and 2, each segment (11) of the shoreline protection system (10) is supported at a desired position within a body of water (3) by first and second piles (71, 72), which can be buried in the seabed (2) and spaced as dictated by specific environmental conditions at the installation site. The structure and the placement of the piles (71, 72), required to support the barriers (20*a*, 20*b*), can be determined by utilizing geotechnical principals. Specific considerations in selection of the appropriate piles (71, 72) can include size, length, and spacing, all of which can control the ability of the piles (71, 72) to transmit forces, caused by moving water and gravity, to the underlying seabed (2). These design parameters can play a significant role in the total lateral deflection of the piles (71, 72) and, therefore, the corresponding barriers (20*a*, 20*b*).

The amount of horizontal deflection of the barriers (20*a*, 20*b*) is of concern for several reasons. First, if the pile (71, 72) size is inadequate and the pile deflects excessively, failure can result within the structure from unforeseen forces. However, if piles (71, 72) are sufficiently thick to eliminate all or most deflection of the barriers (20*a*, 20*b*), due to pile bending, the increase in weight and difficulty in transportation and installation of the shoreline protection system (10) may be significant. Weighing the above considerations, an acceptable pile deflection of about six inches was within the acceptable range. Sizing the piles (71, 72) to allow a small horizontal deflection, like six inches, under strong wave forces, provides the pile with the capacity to withstand greater wave forces without being too thick, so that the piles (71, 72) are not too heavy. Second, as the seabed (2) material supporting each pile (71, 72) often consists of soil and/or other particulate material, short and long term movement of soil around the pile (71, 72), is also a consideration. Therefore, if a pile (71, 72) is not supported by a sufficient amount of soil making contact with the surface area of each pile, over a period of time, the orientation or the position of the piles (71, 72) may change relative to the seabed (2), and portions of the shoreline protection system (10) may dislodge from the seabed (2) and tip over. Still another consideration in selecting the pile configuration is the potential for structural undermining of the piles (71, 72) due to scour action around the piles. As a precaution, an additional pile depth can be added to the lengths of the piles (71, 72) to account for possible scouring.

Referring again to FIGS. 1 and 2, based on the above performance considerations, the piles (71, 72) comprise a length of about 70 feet, a diameter of about 24 inches, and wall thickness of about 0.50 inches. Furthermore, the piles supporting each barrier (20*a*, 20*b*) are spaced about 25 feet center to center. Also, as typical scour depth, due to fast moving water, is between 1 and 5 feet, a 1 to 5 foot length can be added to the overall lengths of the piles (71, 72) as a precaution to account for possible scouring. Although the depicted embodiments of the shoreline protection system (10) include the above described piles (71, 72), it should be understood that other embodiments (not shown) of the shoreline protection system (10) can include other pile configurations, which can be controlled by the specific water and seabed conditions of the shoreline environment. Specifically, the pile length may range between 20 and 100 feet, wherein the shorter piles can be used to support lighter barriers located in waters having low energy waves, while longer piles can be used with heavier barriers located in waters having high energy waves.

The structural integrity and stability of the shoreline protection system (10) can be enhanced by connecting the first barrier (20*a*) to the second barrier (20*b*). As depicted in FIGS. 1, 3B, and 4B, the barriers (20*a*, 20*b*) can be connected by two laterally extending steel wide flange beams (81, 82), shown in FIGS. 3B and 4B respectively, extending between corresponding first pair of pile jackets (61) and the second pair of pile jackets (62). This connection is differed from all other members of the segment (11) in the way that the lateral beams (81, 82) are loaded. While all other components of the shoreline protection system (10) are subjected largely to shear and flexure forces, the barrier (20*a*) to barrier (20*b*) lateral beams (81, 82) are subjected to shear, flexure, and axial compression. Based on the variety of forces applied to the lateral beams (81, 82), other beam configurations, such as W, H, or I shaped beams, are usable in an embodiment of the shoreline protection system (10). In the embodiment of the shoreline protection system (10) depicted in FIGS. 1, 3B, and 4B, a W12×45 beam is showed as the barrier (20*a*) to barrier (20*b*) lateral beam (81, 82).

In certain shoreline environments, additional barriers may be necessary or beneficial for improving or increasing wave attenuation. Although the embodiment of the segment (11) of the shoreline protection system (10), shown in FIG. 1, depicts two barriers (20*a*, 20*b*), additional barriers (not shown), each having a construction similar or the same as described herein, may be used as part of the shoreline protection system (10). Furthermore, although the embodiment of the shoreline protection system shown in FIG. 1 comprises two barriers (20*a*, 20*b*), in certain shoreline environments, a shoreline protection system (10), having a single barrier and comprising a construction similar or the same as described herein, may be used to sufficiently attenuate waves.

One of the key objectives of the shoreline protection system (10), depicted in FIG. 1, is its durability and extended operating (i.e., design) life. A steel framing (31, 32) can be utilized to support the UHMW-PE screen (51) at a specific elevation optimized to attenuate wave energy while allowing for exchange of water, which can flow through the screen openings (53) and underneath the barriers (20*a*, 20*b*). The steel framing (31, 32) can also be coated with a marine epoxy paint, to help resist corrosion. Specifically, a three-part coating system can be utilized to protect all steel components, wherein the coating system can include a prime coat for surface preparation, a corrosion-resistant epoxy coat, and a top coat for UV protection. The steel pilings (71, 72) can also receive the same coating system. Lastly, the coating system can be applied before or following all metal work conducted during the installation of the shoreline protection system (10).

Furthermore, the shoreline protection system (10) can be constructed from various grades of steel, such as ASTM A992 structural carbon steel, or other steel alloys comprising similar strength properties and/or composition to withstand welding temperatures. Hot-rolled shapes, pipes, plates, beams, and bars can be used, which conform to the applicable ASTM specifications for steel manufacturing. Because the piles (71, 72), the pile jackets (61, 62), and the framing (31, 32) need to withstand repetitive wave forces over the operating life of the shoreline protection system (10), these load-bearing elements can preferably be sized by incorporating safety factors into the design to increase the safety and the operating life of the shoreline protection system (10). When appropriately sized, the expected life of the shoreline protection system (10) can be 25 years or longer.

Once the location for the shoreline protection system (10) is chosen and the individual elements are on site, installation procedures can commence. In an embodiment of the shoreline protection system (10), each segment (11) can be assembled off-site and transported onto the site following assembly, along with the piles (71, 72) and other equipment needed to assemble the system. A crane (not shown) can be used to set the initial barrier (20*a*, 20*b*) portion of the segment (11) over temporary piles (not shown) to hold the barrier (20*a*, 20*b*) portion in place. The initial barrier (20*a*, 20*b*) portion can comprise two sets of pile jackets (61, 62), connected with two sets of frames (31, 32) and two lateral beams (81, 82), as depicted in FIG. 1. Once the initial barrier (20*a*, 20*b*) portion is in place, four permanent piles (71, 72) can then be driven through the four jackets (61, 62). The initial portion can then be raised or lowered (if needed) to the proper elevation within the body water. A retaining pin (67, see FIG. 5) can then be placed through the openings in the jackets (61, 62) and the piles (71, 72), extending therethrough, to the other side of the pile and the pile jacket. To secure each pin (67) in place, the pins (67) can be welded or bolted to the pile jackets. When the pins (67) are secured in place, the crane can release the initial portion. The next segment (not shown) can be installed adjacent to the initial segment in a similar fashion and connected to the initial segment (11). The installation steps described above can be repeated until all segments are installed.

In another embodiment (not shown) of the shoreline protection system (10), each segment (11) can be assembled off-site in smaller portions (e.g., halves) and transported onto the site following assembly. Each half segment can comprise one pair of pile jackets (61, 62) and one pair of frames (31, 32), wherein each half segment can be installed on top of the piles (71, 72) as described above. Once the jackets (61, 62) are pinned in place, the barrier to barrier lateral beams (81, 82) can be welded or bolted between the first pair of pile jackets (61, 62) and the second pair of pile jackets (61, 62). The pile jackets (61, 62) can then be covered or capped by welding or bolting a circular plate (63) over each pile jacket (61, 62) opening.

The shoreline protection system (10) can be disassembled and removed by incorporating the above process in reverse order. The jacket pins (67) can be removed, the pile caps (63) and the barrier to barrier lateral beams (81, 82) can be torch-cut or unbolted, and the disconnected segments can be crane-lifted to nearby barges. Piles (71, 72) can be removed through vibratory means and also crane-lifted to nearby barges.

The assembly and disassembly procedures disclosed above represent one embodiment of these processes. It should be understood that other methods or similar methods performed in different order, including different configuration of the preassembled sections, can be utilized and are within the scope of the shoreline protection system (10) of the present disclosure.

While various embodiments usable within the scope of the present disclosure have been described with emphasis, it should be understood that within the scope of the appended claims, the present invention can be practiced other than as specifically described herein. It should be understood by persons of ordinary skill in the art that an embodiment of the shoreline protection system (10) in accordance with the present disclosure can comprise all of the improvements/features described above. However, it should also be understood that each improvement/feature described above can be incorporated into the shoreline protection system (10) by itself or in combinations, without departing from the scope of the present disclosure.

What is claimed is:

1. A method of protecting a shoreline against the erosion effects of waves with a barrier assembly, the method comprising the steps of:

inserting a first pile into a bottom of a body of water;

inserting a second pile into the bottom of the body of water;

providing a first screen having an upper edge, a lower edge, a forward and a rearward face each spanning between the upper and lower edges, and a plurality of apertures;

positioning the first screen between the first pile and the second pile;

moving the first screen vertically to position the lower edge of the first screen at a distance from the bottom of the body of water and the upper edge of the first screen at a distance above a mean height of the body of water;

locking the first screen in position along the first and second piles;

inserting a third pile into the bottom of the body of water;

inserting a fourth pile into the bottom of the body of water;

providing a second screen having an upper edge, a lower edge, a forward and a rearward face each spanning between the upper and lower edges, and a plurality of apertures;

positioning the second screen between the third pile and the fourth pile, wherein the second screen is connected to the third pile and the fourth pile, wherein the second screen is essentially parallel relative to the first screen, wherein the first screen is connected to the first pile and second pile;

moving the second screen vertically to position the lower edge of the second screen at a distance from the bottom of the body of water and the upper edge of the second screen at a distance above the mean height of the body of water;

locking the second screen in position along the third pile and the fourth pile;

connecting a lateral beam to the first pile and the third pile, wherein the lateral beam is essentially perpendicular to both the first screen and the second screen;

providing framing on either or both faces of the first screen, the second screen, or combinations thereof; and providing a plurality of channel U-shaped beam segments affixed to the framing and spaced along a single one of the upper and lower edges of the first and second screens.

2. The method of claim 1, wherein the step of inserting the first pile into the bottom of the body of water comprises inserting the first pile into the bottom of the body of water, such that a portion of the first pile extends above a surface of the body of water, and wherein the step of inserting the second pile into the bottom of the body of water comprises inserting the second pile into the bottom of the body of water, such that a portion of the second pile extends above the surface of the body of water.

3. The method of claim 1, wherein the step of inserting the first pile into the bottom of the body of water comprises inserting more than half of the first pile into the bottom of the body of water, and wherein the step of inserting the second pile into the bottom of the body of water comprises inserting more than half of the second pile into the bottom of the body of water.

4. The method of claim 1, wherein the step of providing framing comprises:

positioning an upper beam between the first pile and the second pile adjacent the upper edge of the first screen to support the first screen; and positioning a lower beam between the first pile and the second pile adjacent the lower edge of the first screen to support the first screen.

5. The method of claim 1, wherein the step of positioning the first screen between the first pile and the second pile comprises the steps of:

providing a first tubular member in connection with the first screen;

providing a second tubular member in connection with the first screen;

positioning the first tubular member about the first pile to maintain the first screen in position relative to the first pile; and positioning the second tubular member about the second pile to maintain the first screen in position relative to the second pile.

6. The method of claim 1, further comprising positioning the lateral beam between the first pile and the third pile to add structural support to the barrier assembly.

7. A barrier for protecting waterfront area from erosion due to waves, the barrier comprising:

a first pile comprising an upper end and a lower end, wherein the lower end of the first pile is insertable into a bottom of a body of water;

a second pile comprising an upper end and a lower end, wherein the lower end of the second pile is insertable into the bottom of the body of water;

a first screen having an upper edge, a lower edge, a forward and a rearward face each spanning between the upper and lower edges, and a plurality of apertures extending therethrough, wherein the first screen is connected to the first pile and the second pile at a distance from the bottom of the body of water;

a third pile comprising an upper end and a lower end, wherein the lower end of the third pile is insertable into the bottom of the body of water;

a fourth pile comprising an upper end and a lower end, wherein the lower end of the fourth pile is insertable into the bottom of the body of water;

a second screen having an upper edge, a lower edge, a forward and a rearward face each spanning between the upper and lower edges, and a plurality of apertures extending therethrough, wherein the second screen is connected to the third pile and the fourth pile at a distance from the bottom of the body of water;

a lateral beam connecting the first pile with the third pile, wherein the lateral beam is essentially perpendicular to both the first screen and the second screen;

framing comprising at least one pair of horizontal support beams, at least one pair of vertical support beams, or combinations thereof on either or both faces of the first screen, the second screen, or combinations thereof; and a plurality of channel U-shaped beam segments spaced along a single one of the upper and lower edges of the first and second screens.

8. The barrier of claim 7, further comprising a screen porosity range of 2% to 10% for each of the first screen and the second screen.

9. The barrier of claim 7, wherein the plurality of channel U-shaped beam segments are securably retained to the framing.

10. The barrier of claim 7, further comprising a plurality of bolts placed through the framing and the first screen, the second screen, or both for retaining the first screen, the second screen, or both in position.

11. The barrier of claim 7, further comprising a plurality of brackets fixed to the framing for retaining the first screen, the second screen, or both in position.

12. The barrier of claim 7, further comprising another lateral beam connecting the second pile with the fourth pile, wherein the another lateral beam is essentially perpendicular to both the first screen and the second screen.

13. The barrier of claim 7, wherein a distance between the upper end of the first pile and the bottom of the body of water is smaller than a distance between the bottom of the body of water and the lower end of the first pile.

14. The barrier of claim 7, further comprising one or more pile jackets, wherein each pile jacket is positioned about a different pile comprising the first pile, the second pile, the third pile, and the fourth pile.

15. The barrier of claim 14, further comprising one or more circular plates on the one or more pile jackets.

16. The barrier of claim 14, further comprising one or more pile jacket flanges on the one or more pile jackets.

17. The barrier of claim 14, further comprising a retaining pin through any of the one or more pile jackets.

* * * * *